US008650787B2

(12) United States Patent
McCormick

(10) Patent No.: US 8,650,787 B2
(45) Date of Patent: Feb. 18, 2014

(54) SPRING ACTION MAGAZINE FOLLOWER AND MAGAZINE FOR FIREARMS

(76) Inventor: Michael L. McCormick, Spicewood, TX (US)

( * ) Notice: Subject to any disclaimer, the term of this patent is extended or adjusted under 35 U.S.C. 154(b) by 149 days.

(21) Appl. No.: 13/004,699

(22) Filed: Jan. 11, 2011

(65) Prior Publication Data

US 2011/0173856 A1 Jul. 21, 2011

Related U.S. Application Data

(60) Provisional application No. 61/296,014, filed on Jan. 18, 2010.

(51) Int. Cl.
*F41A 9/61* (2006.01)

(52) U.S. Cl.
USPC ..... 42/50; 42/18; 42/49.01

(58) Field of Classification Search
USPC ..... 42/50, 18, 49.01
See application file for complete search history.

(56) References Cited

U.S. PATENT DOCUMENTS 2,944,357 A 7/1960 Smith et al.
3,905,142 A * 9/1975 Haskell ..... 42/18
4,446,645 A 5/1984 Kelsey, Jr. et al.
4,502,237 A * 3/1985 Krogh ..... 42/50
4,811,510 A 3/1989 Chesnut
4,993,180 A 2/1991 Upchurch
5,099,595 A 3/1992 Chesnut et al.
5,263,273 A * 11/1993 Lishness ..... 42/50
5,497,580 A 3/1996 Vanderplaats
6,560,907 B1 5/2003 Vieweg
6,952,894 B1 * 10/2005 Vieweg ..... 42/50
7,047,686 B2 5/2006 Zimmermann
7,200,963 B1 * 4/2007 Vieweg et al. ..... 42/49.01
7,530,191 B2 5/2009 Szabo
2011/0173856 A1 * 7/2011 McCormick ..... 42/50
2011/0277366 A1 * 11/2011 Steffes et al. ..... 42/50

* cited by examiner

*Primary Examiner* — Michelle Clement
(74) *Attorney, Agent, or Firm* — The Culbertson Group, PC; Russell D. Culbertson

(57) ABSTRACT

A follower for a firearm magazine includes a base part, a guide, a cartridge engaging part, and a slide stop actuating structure. The base part provides a lower surface against which the magazine spring acts, and the guide provides a guide surface extending transverse to a base plane defined by the base part. The cartridge engaging part provides a spring action within the follower itself to augment the force of the magazine spring. The slide stop actuating structure is located at a front end of the base part and provides an inclined engagement surface that extends upwardly from the front end of the base part to a front edge of the follower. This upwardly angled surface forms an engagement surface to reliably engage a slide stop lug of a firearm to actuate the firearm's slide stop mechanism when the magazine is empty.

14 Claims, 4 Drawing Sheets

SPRING ACTION MAGAZINE FOLLOWER AND MAGAZINE FOR FIREARMS

CROSS-REFERENCE TO RELATED APPLICATION

The Applicant claims the benefit, under 35 U.S.C. §119(e), of U.S. Provisional Patent Application No. 61/296,014 filed Jan. 18, 2010, and entitled "SPRING-ACTION MAGAZINE FOLLOWER AND MAGAZINE FOR FIREARMS." The entire content of this provisional application is incorporated herein by this reference.

TECHNICAL FIELD OF THE INVENTION

The present invention relates to firearms, and, more particularly to magazines and magazine followers used in firearms. The invention includes a magazine follower having a slide stop engagement structure that helps consistently and positively actuate the slide leek stop mechanism of the firearm.

BACKGROUND OF THE INVENTION

In semiautomatic or automatic firearms, the cartridges which are fired are commonly stored in a detachable magazine. The magazine defines an enclosure adapted to contain at least one column of cartridges. The cartridges are loaded into the magazine so as to be located atop a magazine follower which engages a lowermost cartridge in the magazine. A magazine spring is included in the magazine and is compressible between the magazine follower and a bottom portion of the magazine so as to bias the follower and loaded cartridges upwardly in the magazine toward an upper open end. An uppermost cartridge from the magazine is loaded into a firing position in the firearm by cooperation with a slide of the firearm. The slide is adapted to be moveable from an initial firing position rearwardly with respect to the firearm frame, barrel, and magazine and then return forwardly under a spring biasing force. During the returning forward movement of the slide, the slide contacts and strips the uppermost cartridge from the magazine. Under the contact from the slide and the biasing force from the magazine spring, the cartridge moves upwardly with respect to the magazine and forwardly in the firearm, ultimately reaching a firing position in the firing chamber of the firearm. When a loaded magazine is first placed in the firearm, the slide may be manually cycled to place the first cartridge from the magazine in the firing position. Thereafter, energy from the fired cartridge is used to cycle the slide to eject the casing of the fired cartridge and load the next cartridge from the magazine into the firing chamber. In this manner, each successive shot fired causes the magazine follower and the column of cartridges to incrementally travel upwardly, and each successive cartridge is fed into the firing position in the firearm until no further cartridges remain in the magazine.

A firearm may be designed so that when the last cartridge from the magazine is fired and the magazine is thus empty, the slide locks open and does not complete its full cycle of movement. This slide locking gives the operator an important visual indication that the magazine is empty. This visual indication provided by the slide locking in an open position is extremely important in a combat, law enforcement, or personal defense setting in which it is not practical for the operator to keep track of the number of cartridges they have fired from a given magazine. The locked open slide informs the operator that they must take cover and reload.

The slide stop mechanism for locking the slide in the open position when the magazine is empty may include a lever mounted on the firearm frame. This slide stop lever is mounted so that it may move between a locking position in which it catches on a notch or other feature of the slide, and a retracted position in which the slide is free to cycle. The slide stop lever may be biased in some fashion to the retracted position, and, in some firearms, is moved to the locking position by contact with a portion of the magazine follower. In particular, the slide stop lever may include or be connected to a slide stop lug which extends through an opening in the firearm frame into the area of the firearm that receives the upper end of the magazine. As the last cartridge is stripped from the magazine, the follower reaches its uppermost position in the magazine under the biasing force of the magazine spring. At this point, contact between a portion of the follower and the slide stop lug forces the slide stop lever toward its extended, locking position. Then, when the last cartridge from the magazine is fired, the slide moves rearwardly under the force of the discharge but is caught in the open position by contact between the slide stop lever and the notch or other locking feature on the slide.

Several different types of magazine followers have been developed for firearms in which the follower is used to actuate the slide stop, each having a somewhat different structure for contacting the slide stop lug so as to move the slide stop lever to the extended, locking position. Molded plastic followers include a base part with a guide skirt that commonly depends from the base part around its entire periphery. The upper end of the magazine spring is adapted to fit into the recess formed by the skirt. These molded plastic followers require a cutout at a front end of the base and skirt structure to produce a slide stop actuating surface below the plane of the base part. This cutout area and slide stop actuating surface must be below the plane of the base part because the base part would otherwise contact the slide stop lug and actuate the slide stop prematurely while the last cartridge remained in the magazine. U.S. Pat. No. 7,047,686 shows a molded plastic follower having a cutout area and a slide stop actuating surface below the plane of the base part.

A second type of follower, usually made from a thin plate or sheet of metal, includes a base part and a part that is cut and bent relative to the base to provide a stair-step like structure. This stair-step like structure provides a slide stop actuating surface which is located well below the plane of the follower base part similarly to the slide stop actuating surface of the molded plastic follower. This positioning below the plane of the follower base part is again required in order to prevent premature actuation of the slide stop while the last cartridge remains in the magazine. U.S. Pat. No. 2,944,357 provides an example of this stair-step like follower.

A third type of follower is shown in U.S. Pat. No. 4,446,645. This type of follower includes a spring action built in to the follower itself and will be referred to herein as a spring-action follower. The spring-action follower shown in U.S. Pat. No. 4,446,645 includes a base part, a rear guide, and a cartridge engaging part that forms a leaf spring with respect to the base part. The cartridge engaging part provides additional spring action to bias the cartridges upwardly in the magazine and allows the magazine to use a weaker magazine spring. This weaker magazine spring may be compressed into a smaller fully compressed position and the cartridge engaging part may be compressed to allow at least one additional cartridge to be held in the magazine without changing the length of the magazine. As shown particularly in FIGS. 1 and 2 of U.S. Pat. No. 4,446,645, a finger portion is located at a front end of the base part. This finger portion provides a slide stop actuating surface for the follower.

SUMMARY OF THE INVENTION

The present invention encompasses a spring-action type follower having a unique slide stop actuating structure that reliably engages the slide stop mechanism of the firearm to lock the slide in the open position when the last cartridge from the magazine is fired. The invention also encompasses a magazine employing the spring-action type follower.

In one form, a follower embodying the principles of the invention includes a base part, a guide, a cartridge engaging part, and a slide stop actuating structure. The base part provides a lower surface against which the magazine spring acts, and the guide provides a guide surface extending transverse to a base plane defined by the base part. The guide surface is oriented so as to help guide the follower smoothly through the magazine and to help keep the base part of the follower in the proper orientation.

The cartridge engaging part is located on an upper side of the base part, facing an upper surface of the base part. A portion of the cartridge engaging part is resiliently biased away from the upper surface of the base part, and is adapted to move between a compressed position in which it lies adjacent to the upper surface of the base part, and an extended position in which it is separated from the upper surface of the base part. The biasing of the cartridge engaging part provides a spring action in addition to the spring force provided by the magazine spring below the follower in the magazine.

The slide stop actuating structure is located at a front end of the base part and provides an inclined engagement surface that extends upwardly from the front end of the base part to a front edge of the follower. In one preferred form, the slide stop actuating structure and base part are formed from a common piece of metal plate having a front end with a semicircular shape with a diameter equal to the lateral width of the plate. This front semicircular part is bent upwardly generally along a line defined by the two ends of the semicircular shape to form the slide stop actuating structure. For example, the front portion of the plate may be bent upwardly to form an angle of approximately 15 degrees with the base plane. This upwardly angled planar surface forms the engagement surface in this particular form of the follower.

A magazine according to the present invention includes a magazine box having a lower wall, front side wall, a rear side wall, and two laterally spaced side walls extending between the front side wall and rear side wall. The walls of the magazine box define a volume for containing a number of firearm cartridges. A follower as described above is positioned within the magazine box oriented with the slide lock engagement structure facing the front side wall and the opposite end of the base part at the magazine rear side wall. A magazine spring is positioned within the magazine box so as to act between the base part of the follower and the lower wall of the magazine box to bias the follower upwardly toward a top opening in the magazine box. This top opening is configured with a retainer structure to retain the loaded cartridges in the magazine against the force of the magazine spring but allow the individual cartridges to be stripped forward out of the magazine.

When the last cartridge in the magazine is stripped out of the magazine to leave the magazine empty of cartridges, the force of the magazine spring pushes the follower according to the invention to its uppermost position in the magazine. As the follower moves to this uppermost position, the slide stop actuating structure reliably engages the slide stop lug on the firearm to raise the slide lock to its extended position in which it may catch and lock the slide in the open position.

These and other advantages and features of the invention will be apparent from the following description of the preferred embodiments, considered along with the accompanying drawings.

DESCRIPTION OF ILLUSTRATIVE EMBODIMENTS

Figure 1:
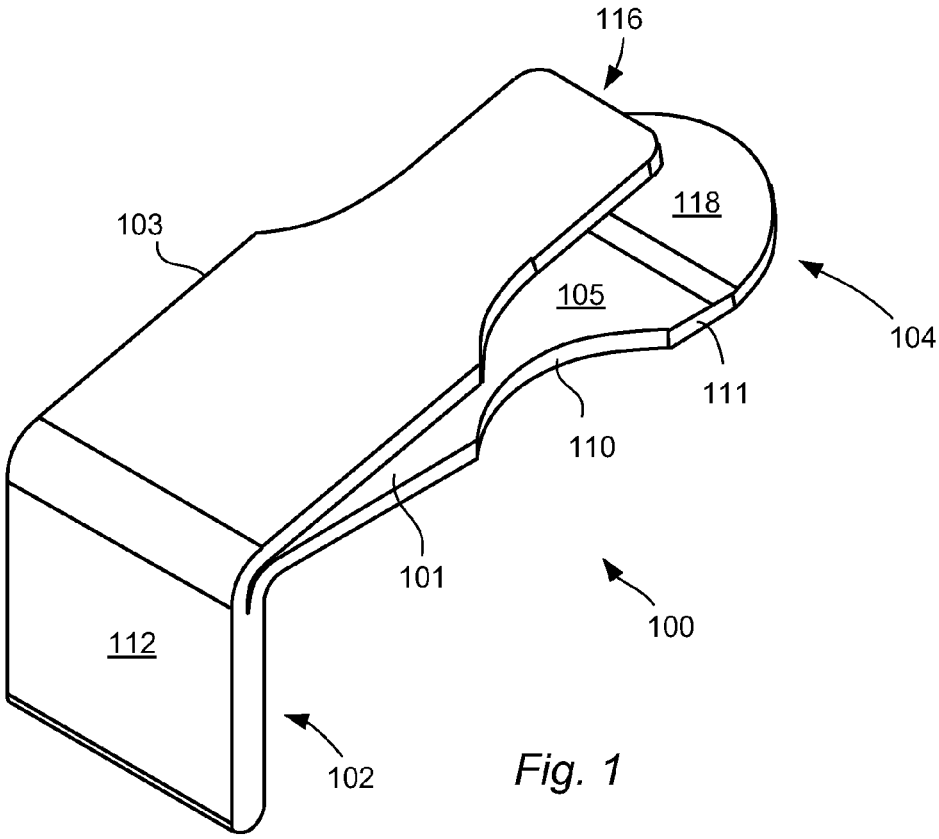
FIG. 1 is an isometric view of a follower embodying the principles of the present invention, with the cartridge engaging part of the follower in an extended position.

In the following description, the structure of one embodiment of a follower embodying the principles of the invention will be described with reference to FIGS. 1-5, along with certain variations within the scope of the present invention. A magazine according to the present invention and the operation of the follower and magazine will then be described in connection with FIGS. 6-8.

In this disclosure and the accompanying claims, terms such as "upper," "lower," "front," "rear," "top," and "above" are used to describe various surfaces and other features of followers and magazines embodying the present invention. It should be appreciated that these terms are used in the context of the orientation of structures shown in the accompanying drawings.

Referring now particularly to FIGS. 1-4, a follower 100 includes a base part 101, a guide 102, and a cartridge engaging part 103. Follower 100 also includes a slide stop actuating structure indicated generally by reference numeral 104.

Figure 3:
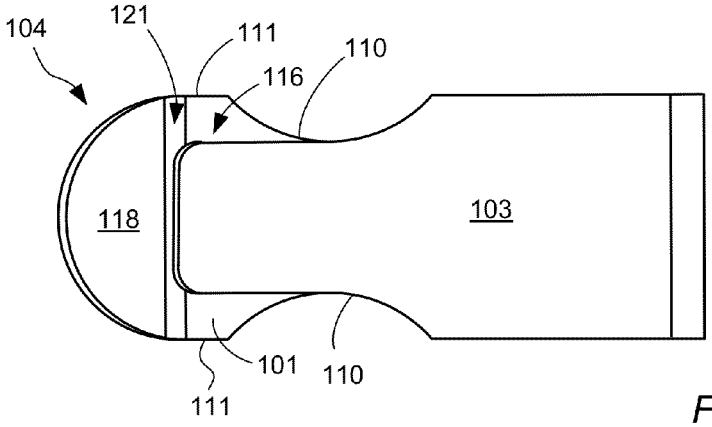
FIG. 3 is a top view of the follower shown in FIG. 1.

In this particular embodiment, base part 101 comprises a flat piece of material, with an upper surface 105 and lower surface 106, and defining a base plane shown at reference numeral 107. A front end of the base part is indicated at reference numeral 108 and a rear end of the base part is indicated at reference numeral 109. As shown in FIG. 3, the illustrated base part 101 has a generally rectangular shape in plan view, but with lateral indentations 110 on each lateral 111 side toward the front end 108.

Guide 102 in the illustrated embodiment is located at the rear end 109 of the base part. Guide 102 provides a guide surface 112 that extends transverse to base plane 107 below base part 101. As will be explained in greater detail below, the illustrated guide 102 is formed integrally with base part 101 from a length of material. In particular, guide 102 is formed by a first bend in the length of material downwardly in the orientation of FIGS. 1 and 2. This first bend defines the rear end 109 of base part 101. The material is then bent back on itself to define the lowermost part of guide 102, and with the guide then made up of a forward length 113 of the material and a rearward length 114 of the material. Guide 102 of the illustrated follower 100 extends at approximately 90° to base plane 107. However, other angles may be used within the scope of the invention. In particular, it may be desirable for guide 102 to extend somewhat rearwardly from the rear end 109 of base part 101 and at an obtuse angle with respect to base plane 107 to help maintain the base plane in the desired orientation in the magazine. In some implementations of the present invention, it may be desirable for guide 102 to be angled with respect to base part 101 so that a rear surface of guide 102 runs approximately parallel to a rear wall of the magazine box as the follower travels along the length of the magazine. However, guide 102 need not extend approximately parallel to the rear wall of the magazine box in some forms of the present invention.

Cartridge engaging part 103 is located above base part 101, with a portion that is resiliently biased away from upper surface 105 of base part 101. In this particular embodiment, in which cartridge engaging part 103 is integrally formed with the other parts of follower 100 from a common length of material, essentially the entire length of the cartridge engaging part is resiliently biased away from upper surface 105 of base part 101 to the extended position shown in FIG. 1. The bias is provided by the resiliency in the material particularly at a root 115 of the cartridge engaging part where it transitions to the rearward part 114 of guide 102. Cartridge engaging part 103 is movable between a compressed position, shown in FIG. 4, in which it lies generally adjacent to upper surface 105 of base part 101, and the extended position, shown best in FIGS. 1 and 2, in which cartridge engaging part 103 is separated from upper surface 105 of the base part 101. The resiliency of the material from which cartridge engaging part 103 is formed allows the part to function as a spring as will be described further below in connection with FIGS. 6 and 7. The angle at which cartridge engaging part 103 extends with respect to base plane 107 may depend upon the particular magazine with which it is to be used, but may be approximately 15 degrees in some implementations.

Figure 4:
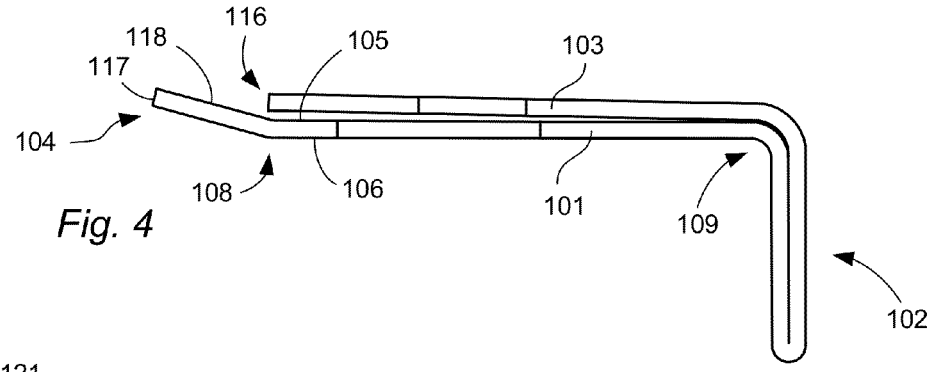
FIG. 4 is a left side view similar to FIG. 2 but with the cartridge engaging part in a compressed position.

It will be noted particularly from FIG. 4 that the length of cartridge engaging part 103 is significantly shorter than the overall length of follower 100. In the fully compressed position shown in FIG. 4, a front end 116 of cartridge engaging part 103 lies generally at front end 108 of base part 101. The length of cartridge engaging part 103 prevents it from contacting the inclined slide stop actuating structure 104, and allows the cartridge engaging part to lie substantially flat against top surface 105 of base part 101 in the compressed position of FIG. 4. Also, as is apparent from the plan view of FIG. 3, cartridge engaging part 103 may be narrower at its front end 116.

Slide stop actuating structure 104 begins at front end 108 of base part 101 and extends forwardly to the front edge 117 of follower 100. Slide stop actuating structure 104 provides an inclined engagement surface 118 extending upward at an inclination angle 119 with respect to the base plane 107. In one preferred form of follower 100 suited particularly for .45 caliber cartridges and the Model 1911 semiautomatic pistol, inclination angle 119 is approximately 15 degrees with respect to base plane 107. However, inclination angle 119 may vary from a minimum of approximately 5 degrees to a maximum of approximately 20 degrees depending on the size of cartridges and the particular firearm in which the follower is intended to be used. Somewhat smaller or steeper angles may also be used in accordance with the present invention.

Figure 2:
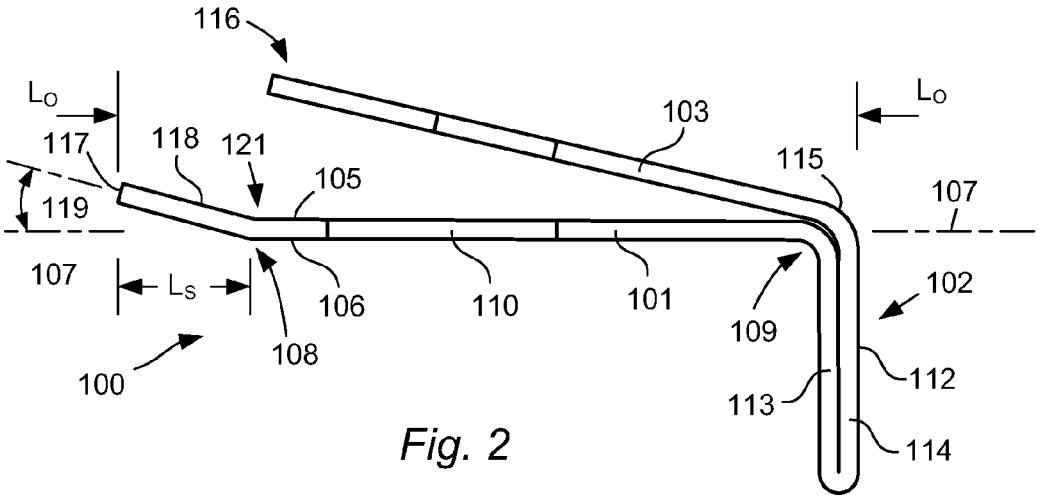
FIG. 2 is a left side view of the follower shown in FIG. 1.
Figure 5:
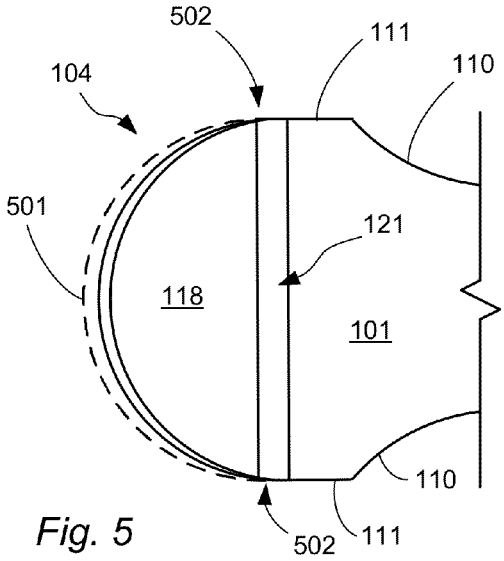
FIG. 5 is a top view of the slide stop actuating structure and front portion of the base part with a dashed line showing the position of the front edge of the length of material prior to bending to form the slide stop actuating structure.

In the particular follower 100 shown in FIGS. 1-4, slide stop actuating structure 104 is also formed integrally with base part 101 from a length of appropriate material. In this embodiment, slide stop actuating structure 104 is formed by bending a front part of the length of material upwardly using a bending process suitable for the particular material. It will be appreciated that since a bend in the material is used to form slide stop actuating structure 104, there is not a discrete point along the length of follower 100 at which base part 101 ends and the slide stop actuating structure begins. Rather, there is a somewhat curved transition area between base part front end 108 of base part 101 and the end of slide stop actuating structure 104 proximal to the front end of the base part. This curved transitional area is indicated in FIGS. 2, 3, and 5 at reference numeral 121. Also, forming slide stop actuating structure 104 by bending the part up from a length of material also forming base part 101 produces an advantageous change in the overall shape of the front of follower 100 in base plane 107. This shape is shown best in FIG. 5, which shows an enlarged plan view of just the front portion of base part 101 and slide stop actuating structure 104. The shape of follower 100 in this plan view (which coincides with the shape of the follower in base plane 107) is shown in solid lines in FIG. 5, whereas the shape of the length of material before bending is shown with a dashed line 501 in the figure. As can be appreciated from FIG. 5, the shape of the length of material before bending is semicircular, with the ends of the semicircular shape intersecting with the lateral sides 111 of base part 101. However, once the material is bent upwardly at the front to produce slide stop actuating structure 104, the shape in base plane 107 is no longer perfectly semicircular. Rather, the front edge of the follower comprises a somewhat shallower arcuate shape as compared to the semicircular shape, and there is a slightly angular shape in area 502 on each lateral side of the structure at the transition from base part lateral side 111 to slide stop actuating structure 104. This shape produced by bending the material to produce slide stop actuating structure 104 better matches the rounded front wall of the magazine box (considering the manufacturing practices and tolerances for the magazine box) and reduces the gap that would otherwise be present if the follower shape was a true semicircle as shown by dashed line 501. Although not shown in the figures, the rounded front part of the magazine box (which will be described further below) essentially follows the curvature of the front of follower 100 at a very close clearance. The reduced gap between the front edge of follower 101 and the inside of the magazine front side curved wall helps facilitate the desired reliable engagement between slide stop actuating structure 104 and the slide stop lug of the firearm in operation as will be described below.

The length ($L_S$ in FIG. 2) of slide stop actuating structure 104 in base plane 107 may vary depending on factors such as the dimensions of the magazine and the type of cartridges to be used in the magazine. In a magazine for standard .45 caliber ACP (automatic Colt pistol) cartridges, slide stop actuating structure 104 may be no more than 25% of the overall length of the follower ($L_O$ in FIG. 2), and at least 10% of the overall length of the follower. For example, one preferred follower 100 design specifically for the standard Model 1911 automatic pistol has an overall length $L_O$ of approximately 1.25 inches, and the length $L_S$ of slide stop actuating structure 104 in base plane 107 may be approximately 0.22 inches with an inclination angle of approximately 15 degrees, so that the length $L_S$ makes up approximately 17.6% of the overall length $L_O$ of the follower. As will be described below particularly in connection with FIG. 6, these slide stop actuating structure lengths provide the desired inclined engagement surface 118 at the front of follower 100 without affecting the stacking of cartridges in the magazine in which the follower is used.

As described above, the illustrated follower 100 is integrally formed from a single, continuous length of material which is bent to form slide stop actuating structure 104, base part 101, guide 102, and cartridge engaging part 103. Preferably, this material is a sheet or plate of spring steel. It may also be possible to produce follower 100 by bending or otherwise forming other materials, such as a suitable plastic for example. Although the illustrated follower 100 is constructed from a single piece of material, a follower within the scope of the present invention may be formed from different pieces of material. For example, the base part 101, guide 102, and slide stop actuating structure 104 may be formed from molded plastic, and cartridge engaging part 103 may be formed from a suitable spring metal which is connected in a suitable fashion to the molded plastic part. Any suitable combinations of materials and fabrication techniques may be used to produce a follower according to the present invention with the desired base part 101, slide actuating structure 104, guide 102, and cartridge engaging part 103 providing the desired spring action integral to the follower. Also, numerous variations for the guide 102 are possible within the scope of the present invention. For example, although follower 100 is shown with a single guide 102 at the rear of the follower, a follower within the scope of the invention may include a downwardly depending guide at the front of the follower, extending downwardly from slide stop actuating structure 104. It is also possible for a follower within the scope of the present invention to have a skirt that extends downwardly around the entire periphery of base part 101 and slide stop actuating structure 104.

Figure 6:
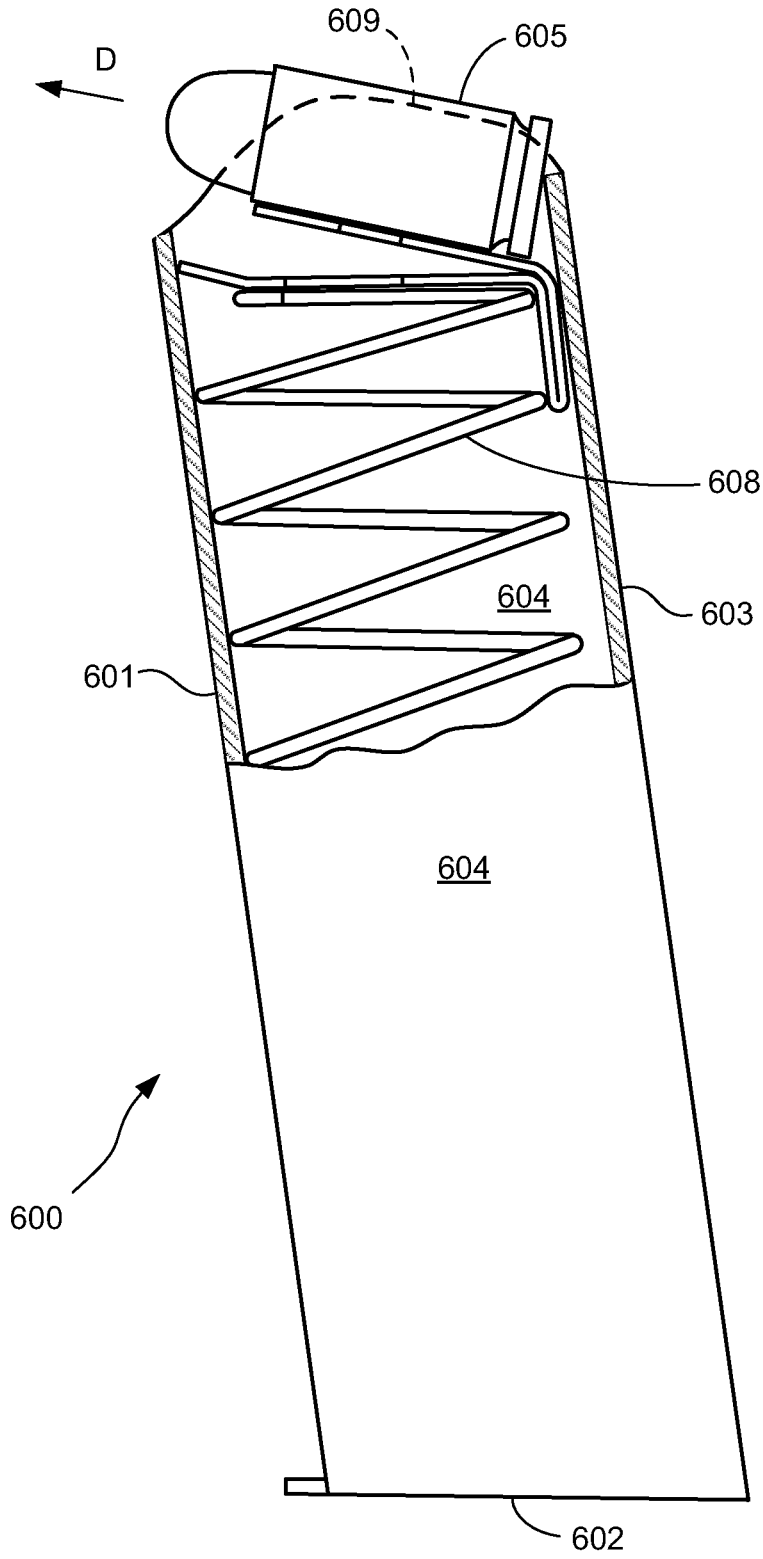
FIG. 6 is a cutaway side view of a magazine embodying the principles of the invention, with one cartridge loaded in the magazine.
Figure 7:
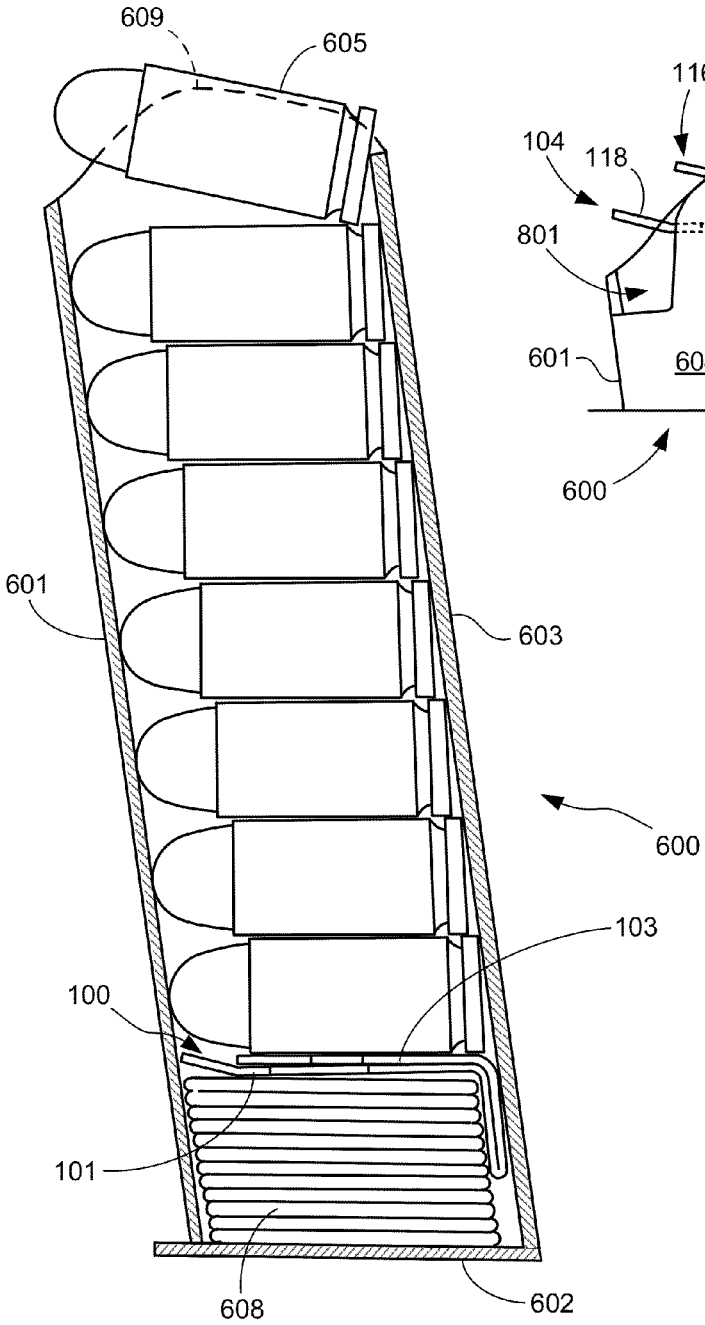
FIG. 7 is a section view of the magazine shown in FIG. 5 in a fully-loaded state.
Figure 8:
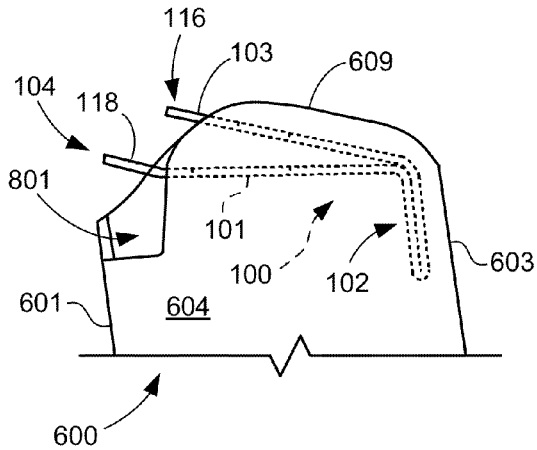
FIG. 8 is a side view of the top portion of the magazine shown in FIG. 6 and showing the position of the follower when the magazine is empty of cartridges.

Referring now to FIGS. 6-8, a magazine 600 within the scope of the present invention has an elongated magazine box having a front side wall 601, a lower wall 602, a rear side wall 603, and two laterally spaced side walls 604. Magazine 600 defines a volume for containing a number of cartridges 605. A follower such as follower 100 described above is included in magazine 600, with a magazine spring 608 acting between base part 101 of follower 100 and magazine lower wall 602. Follower guide 102 cooperates with follower rear side wall 603 to help retain follower 100 in the desired orientation within magazine 600 as the follower moves up and down within the magazine. The open upper end of magazine side walls 604 are provided with inwardly turned retainers 609. These retainers 609 extend inwardly sufficiently to reduce the width at the upper end of magazine 600 to a width less than the width of cartridges 605. Retainers 609 thus provide surfaces on either lateral side of magazine 600 against which the uppermost cartridge 605 is urged by magazine spring 608, and prevent the loaded cartridges from being pushed out of the magazine along the longitudinal axis of the magazine. Retainers 609 are also angled from the front to the rear of magazine 600 to place the uppermost cartridge at a desired angle to be stripped from the magazine along the line indicated by arrow D and moved into a firing position in the firearm (not shown). Aside from retainers 609, magazine 600 is otherwise open at the top to facilitate the desired stripping of the cartridge 605 along the line indicated by arrow D.

Referring particularly to FIG. 7, when magazine 600 is fully loaded with cartridges 605, magazine spring 608 is fully compressed below follower 100. Cartridge engaging part 103 is also fully compressed so as to lie generally against upper surface 105 of base part 101. Both the spring force of magazine spring 608 and cartridge engaging part 103 force the column of cartridges upwardly in magazine 600 toward the top of the magazine. As is known from U.S. Pat. No. 4,446,645, magazine spring 608 may be reduced in strength in view of the spring action provided by cartridge engaging part 103. This reduction in the strength of magazine spring 608 allows the magazine spring to be made of smaller diameter material which allows the spring to compress to a smaller volume in magazine 600. This smaller volume required for the compressed magazine spring allows at least one additional cartridge to be loaded into magazine 600 as compared to the same sized magazine without a spring-action follower.

FIG. 6 shows the condition of magazine 600 in which one cartridge 605 is held in the magazine. This condition occurs after one cartridge 605 is loaded into magazine 600 and in operation of the firearm when one cartridge remains after the others have been stripped from the magazine. It will be noted that in this position, cartridge engaging part 103 has decompressed somewhat toward its extended position to, along with the remaining spring force applied from the partially decompressed magazine spring 608, urge lone cartridge 605 into the desired inclined position against retainers 609. It should also be noted from FIG. 6 that slide stop actuating structure 104 remains within the enclosure provided by magazine 600 when one cartridge is loaded in the magazine.

FIG. 8 shows the upper portion of magazine 600 when no cartridges are loaded in the magazine and follower 100 is biased by magazine spring 608 to its uppermost position in the magazine. It will be noted from FIG. 8 that magazine 600 includes a cutout area 801 along a portion of front side wall 601 and the lateral side wall 604 facing the viewer in the orientation of the figure. This cutout area 801 is configured in magazine 600 to face the slide stop lug of the firearm (not shown). The slide stop lug will in fact protrude slightly into the volume defined by the remainder of the magazine walls. In this position, inclined engagement surface 118 engages the slide stop lug as follower 100 moves to the final position shown in FIG. 8. This engagement between inclined engagement surface 118 and the slide stop lug of the firearm allows the follower to raise the slide stop lug slightly to actuate the slide stop of the firearm. It should be noted from FIG. 8 that cartridge engaging part 103 remains well back from the front of magazine 600, and the front end 116 of the cartridge engaging part does not traverse magazine cutout area 801 as follower 100 moves upwardly in magazine 600 to reach the final position shown in FIG. 8. The position of cartridge engaging part 103 prevents premature contact with the slide stop lug of the firearm even without the narrowing at the front end 116 of the cartridge engaging part shown particularly in FIG. 3.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A firearm magazine follower including:

(a) an elongated base part defining a base plane and having an upper surface and a lower surface;

(b) a rear guide part connected at a rear end of the base part and extending transverse to the base plane from the lower surface of the base part;

(c) a cartridge engaging part located on an upper side of the base part so as to face the upper surface of the base part, the cartridge engaging part having a portion which is resiliently biased away from the upper surface of the base part so as to be movable between a compressed position in which it lies adjacent to the upper surface of the base part and an extended position in which it is separated from the upper surface of the base part; and (d) a slide stop actuating structure at a front end of the base part, the slide stop actuating structure being integrally formed with the base part from a length of material and being bent upwardly with respect to the base part along a transition area extending transverse to a longitudinal axis of the base part across the entire width of the base part in the base plane, the upward bend along the transition area inclining the slide stop actuating structure relative to the base part so that the slide stop actuating structure provides an inclined engagement surface which is inclined upwardly at an angle to the base part from the front end of the base part to a front edge of the follower.

2. The follower of claim 1 wherein the length of material from which the base part and slide stop actuating structure are formed includes a front end that terminates in a constant radius curve in the plane of the material, the constant radius curve having a diameter equal to the lateral width of the length of material, and wherein the length of material is bent upwardly at the base of the constant radius curve to form the incline the slide stop actuating structure.

3. The follower of claim 1 wherein the cartridge engaging part in the compressed state has a front end which lies at the transition area between the base part and the slide stop actuating structure.

4. The follower of claim 1 wherein the base part, rear guide, and cartridge engaging part are integrally formed from a length of spring metal.

5. The follower of claim 1 wherein the length of the slide stop actuating structure in the plane of the base part is no more than approximately 30 percent of the overall length of the follower.

6. A firearm magazine follower including:

(a) an elongated base part defining a base plane;

(b) a guide providing a guide surface extending transverse to the base plane;

(c) an elongated cartridge engaging part having a rear end connected at a rear end of the follower, the elongated cartridge engaging part having a front portion which is resiliently biased upwardly away from an upper surface of the base part; and (d) a slide stop actuating structure at a front end of the base part, the slide stop actuating structure being integrally formed with the base part from a length of material and being bent upwardly with respect to the base part along a transition area extending transverse to a longitudinal axis of the base part across the entire width of the base part in the base plane, the upward bend along the transition area inclining the slide stop actuating structure relative to the base part so that the slide stop actuating structure providesan inclined engagement surface which is inclined upwardly at an angle to the base part from the front end of the base part to a front edge of the follower.

7. The follower of claim 6 wherein the length of material from which the base part and slide stop actuating structure are formed includes a front end that terminates in a constant radius curve in the plane of the material, the constant radius curve having a diameter equal to the lateral width of the length of material, and wherein the length of material is bent upwardly at the base of the constant radius curve to incline the slide stop actuating structure.

8. The follower of claim 6 wherein the cartridge engaging part in the compressed state has a front end which lies at the transition area between the base part and the slide stop actuating structure.

9. The follower of claim 6 wherein the base part, rear guide, and cartridge engaging part are integrally formed from a length of spring metal.

10. The follower of claim 6 wherein the length of the slide stop actuating structure in the plane of the base part is no more than approximately 30 percent of the overall length of the follower.

11. A firearm magazine including:

(a) a magazine box including a lower wall, front side wall, a rear side wall, and two laterally spaced side walls extending between the front side wall and rear side wall, the magazine box defining a volume for containing a number of firearm cartridges;

(b) a follower including, (i) an elongated base part defining a base plane and having an upper surface and a lower surface, (ii) a rear guide part connected at a rear end of the base part and extending transverse to the base plane from the lower surface of the base part, (iii) a cartridge engaging part located on an upper side of the base part, the cartridge engaging part having a portion which is resiliently biased away from the upper surface of the base part so as to be movable between a compressed position in which it lies adjacent to the upper surface of the base part and an extended position in which it is separated from the upper surface of the base part, and (iv) a slide stop actuating structure at a front end of the base part, the slide stop actuating structure being integrally formed with the base part from a length of material and being bent upwardly with respect to the base part along a transition area extending transverse to a longitudinal axis of the base part across the entire width of the base part in the base plane, the upward bend along the transition area inclining the slide stop actuating structure relative to the base part so that the slide stop actuating structure provides an inclined engagement surface which is inclined upwardly at an angle to the base part from the front end of the base part to a front edge of the follower; and (c) a magazine spring acting between the follower and the lower wall of the magazine.

12. The magazine of claim 11 wherein the length of material from which the base part and slide stop actuating structure are formed includes a front end that terminates in a constant radius curve in the plane of the material, the constant radius curve having a diameter equal to the lateral width of the length of material, and wherein the length of material is bent upwardly at the base of the constant radius curve to incline the slide stop actuating structure.

13. The magazine of claim 11 wherein the cartridge engaging part in the compressed state has a front end which lies at the transition area between the base part and the slide stop actuating structure.

14. The magazine of claim 11 wherein the length of the slide stop actuating structure in the plane of the base part is no more than approximately 30 percent of the overall length of the follower.

* * * * *

UNITED STATES PATENT AND TRADEMARK OFFICE

CERTIFICATE OF CORRECTION

PATENT NO. : 8,650,787 B2
APPLICATION NO. : 13/004699
DATED : February 18, 2014
INVENTOR(S) : Michael L. McCormick It is certified that error appears in the above-identified patent and that said Letters Patent is hereby corrected as shown below:

In the Specification

At column 1, line 20: change “slide leek stop” to --slide stop--.

In the Claims

At column 9, line 67: change “providesan” to --provides an--.

Signed and Sealed this
Eighth Day of July, 2014

Michelle K. Lee

Michelle K. Lee
*Deputy Director of the United States Patent and Trademark Office*